US012716415B2

(12) United States Patent
Farnham

(10) Patent No.: US 12,716,415 B2
(45) Date of Patent: Aug. 25, 2026

(54) SCROLL DEVICE WITH TIP SEALS AND BACKUP SEALS

(71) Applicant: Air Squared, LLC, Thornton, CO (US)

(72) Inventor: Scott D. Farnham, Broomfield, CO (US)

(73) Assignee: Air Squared, LLC, Thornton, CO (US)

( * ) Notice: Subject to any disclaimer, the term of this patent is extended or adjusted under 35 U.S.C. 154(b) by 0 days.

(21) Appl. No.: 19/020,627

(22) Filed: Jan. 14, 2025

(65) Prior Publication Data

US 2025/0230812 A1 Jul. 17, 2025

Related U.S. Application Data

(60) Provisional application No. 63/621,375, filed on Jan. 16, 2024.

(51) Int. Cl.
*F04C 27/00* (2006.01)
*F04C 18/02* (2006.01)

(52) U.S. Cl.
CPC ..... *F04C 27/005* (2013.01); *F04C 18/0215* (2013.01)

(58) Field of Classification Search
CPC ..... F04C 27/005; F04C 18/0215; F04C 18/0284; F01C 19/005
See application file for complete search history.

(56) References Cited

U.S. PATENT DOCUMENTS 5,580,228 A 12/1996 Ishikawa et al.
6,074,185 A * 6/2000 Protos ..... F04C 18/0284 418/142
6,336,797 B1 1/2002 Kazakis et al.
6,450,791 B1 9/2002 Kawabata et al.
6,568,692 B2 * 5/2003 Kolodziej ..... F16J 15/0887 277/614
8,057,202 B2 * 11/2011 Haller ..... F04C 27/005 277/394
9,951,871 B2 * 4/2018 Aksit ..... F16J 15/3288
10,167,867 B2 1/2019 Asami et al.
(Continued)

FOREIGN PATENT DOCUMENTS

KR 930001930 Y1 * 4/1993 ..... F04C 27/005

OTHER PUBLICATIONS

International Search Report and Written Opinion for International (PCT) Patent Application No. PCT/US2025/011554, dated Mar. 24, 2025 18 pages.

*Primary Examiner* — Jesse S Bogue
(74) *Attorney, Agent, or Firm* — Sheridan Ross PC

(57) ABSTRACT

A scroll device includes a scroll with a gland seat extending into an involute of the scroll. The gland seat includes a recess defining a first wall, a second wall, and a flat section arranged between the first wall and the second wall. A first radiused corner is interconnected to the first wall and the flat section, and a second radiused corner is interconnected to the second wall and the flat section. The first radiused corner and the second radiused corner are separated by the flat section. A gland seat seal, including a backup seal portion and a tip seal portion, is arranged to couple with the gland seat. The backup seal portion is rounded and arranged inside the gland seat contacting the flat section, while the tip seal portion is arranged at least partially in the first gland seat and in contact with a surface of an opposing scroll.

20 Claims, 5 Drawing Sheets

(56) References Cited

U.S. PATENT DOCUMENTS

| | | | | |
|---|---|---|---|---|
| 11,725,657 | B2 * | 8/2023 | Wei | F04C 27/005 418/55.1 |
| 2005/0249623 | A1 | 11/2005 | Tsuchiya et al. | |
| 2007/0071626 | A1 | 3/2007 | Tsuchiya et al. | |
| 2009/0104061 | A1 | 4/2009 | Haller | |
| 2022/0034322 | A1 | 2/2022 | Wei et al. | |

* cited by examiner

SCROLL DEVICE WITH TIP SEALS AND BACKUP SEALS

CROSS-REFERENCE TO RELATED APPLICATIONS

The present application claims the benefit of and priority, under 35 U.S.C. § 119(e), to U.S. Provisional Application Ser. No. 63/621,375, filed on Jan. 16, 2024, entitled "SCROLL DEVICE WITH TIP SEALS AND BACKUP SEALS," the entire disclosure of which is hereby incorporated herein by reference, in its entirety, for all that it teaches and for all purposes.

BACKGROUND

The present disclosure generally relates to scroll devices, and relates more particularly to scroll devices with tip seals and backup seals that are seated in corresponding gland seats.

Scroll devices have been used as compressors, expanders, pumps, and vacuum pumps for many years. In orbiting scroll devices, an orbiting scroll rotates eccentrically while a fixed scroll remains fixed. In a co-rotating or spinning scroll device, two opposing scrolls with misaligned scroll shafts co-rotate. In such devices, a motor turns a shaft that causes the orbiting scroll to orbit eccentrically within the fixed scroll. The eccentric orbit forces a gas through and out of pockets created between the orbiting scroll and the fixed scroll, thus creating a vacuum in a container in fluid communication with the scroll device. An expander operates with the same principle, but with expanding gas causing the orbiting scroll to orbit in reverse and, in some embodiments, to drive a generator. When referring to compressors, it is understood that a vacuum pump can be substituted for a compressor and that an expander can be an alternate usage when the scrolls operate in reverse from an expanding gas.

BRIEF SUMMARY

Scroll devices may include a first scroll having a first involute and a second scroll having a second involute that is nested in, or engaged with, the first involute. In the case of a scroll compressor, the working fluid moves from a periphery (e.g., an inlet) of the first involute and the second involute towards the center (e.g., a discharge port, or outlet, etc.) of the first involute and the second involute through increasingly smaller pockets, generating compression of the working fluid. Similar principles apply for a scroll vacuum pump and/or a scroll expander configuration.

In some embodiments, the scroll device may include one or more tip seals arranged between the first scroll and the second scroll. These tip seals may be disposed along a distal edge, or tip, of each involute of the scroll device. The tip seals may prevent leakage of working fluid from inside these pockets (e.g., the areas between the first involute and the second involute, etc.). More specifically, a tip seal may be provided along the edge of the first involute that is proximate the second scroll (such that the tip seal contacts the second scroll), and another tip seal may be provided along the edge of the second involute that is proximate the first scroll (such that the tip seal contacts the first scroll).

It is desirable to provide increased reliability of the tip seals and to further prevent leakage of the working fluid from inside of the pockets. Thus, according to at least one embodiment of the present disclosure, a backup seal may be provided in a rounded gland seat formed in one or more of the involutes of the scroll device. This backup seal may bias the tip seal against the opposing scroll, for example, by exerting a force onto the tip seal thereby pushing the tip seal against the surface of the opposing scroll. The gland seat may be formed having a fully rounded or a partially rounded shape. When partially rounded, each wall of the involute is finished with corner radii and a flat section, or flat transition surface, disposed between the between the corner radii. In embodiments where the gland seat is rounded or partially rounded, the backup seal may be rounded or circular in shape. In other embodiments, the gland seat may be rectangularly shaped to receive a rectangular backup seal.

Among other things, the shape of the gland seat, including two radiused portions separated by a flat portion, provides a reliable machining or forming of the inner contact with a tubular seal member. Moreover, this shape of the gland seat ensures a consistent distance between the tip seal and the bottom of the seat is maintained. For instance, the base of the gland seat at the flat portion may be machined or formed in the involute having a predetermined dimension (e.g., depth) from the sealing end of the involute. In some embodiments, the predetermined dimension may be machined using a milling machine (e.g., a computer numerical control ("CNC") machine, etc.). In one embodiment, the milling machine may move an end mill along a path of the involute while the end mill cuts into the material of the protrusion portion of the involute forming a recess of the gland seat. Additionally or alternatively, the milling machine may move the involute relative to the end mill while the straight end mill cuts into the material the protrusion portion of the involute forming the recess of the gland seat. In any event, the depth dimension of the base of the gland seat may be formed at a higher precision level (e.g., tighter tolerance range) when using a straight end mill or a tapered end mill, than when using a ball end mill.

In some embodiments, the shape of the gland seat, including two radiused portions separated by a flat portion, allows a flexible and/or compliant tubular member (e.g., an extruded gasket, O-ring section, seal, etc.) to contact the radiuses as the compliant tubular member is compressed (e.g., the compression of the tubular member may provide a normal force of the tip seal against the opposing scroll). Additionally or alternatively, this shape of the gland seat may increase the strength of the portions of the involute that surround the gland seat by, for example, including more material in the two radiused areas than if the radiuses were not formed (e.g., by a straight end mill only, etc.). This arrangement also offers the benefit of reducing, or removing, stress concentration areas at the base of the gland seat and the inner sidewalls of the gland seat.

The gland seat seal may be made from one part, two parts, or more than two parts. In some embodiments, the gland seat seal may include a backup seal that inserts into the gland seat first and a tip seal that inserts into the gland seat in contact with the backup seal. In one embodiment, the gland seat seal may be made as a unified tip and backup seal that includes a backup portion on one side of the gland seat seal that contacts the flat section surface, or base, of the gland seat of first scroll, and a tip portion on another side of the gland seat seal that is configured to contact a surface of a second (e.g., opposing) scroll.

The gland seat seal, and/or any portion of the gland seat seal, may be made from a compliant material that is configured to elastically compress between the base (e.g., flat section surface, etc.) of a gland seat disposed in a first involute of a first scroll and an opposing surface of a second scroll. Examples, of the gland seat seal material may include, but are in no way limited to, an ethylene propylene, fluoroelastomer, fluorosilicone, neoprene, nitrile, perfluoroelastomer, polymer, polysiloxane, polyurethane, propylene, rubber, silicone, tetrafluoroethylene, trafluoroethylene/propylene, etc., and/or combinations thereof. The gland seat seal may be arranged in a fixed scroll, an orbiting scroll, and/or both the fixed scroll and the orbiting scroll of a scroll device. In co-rotating or spinning scroll device arrangements, the gland seat seal may be arranged in one or both scrolls.

In one embodiment of the present disclosure, a scroll device includes a fixed scroll, an orbiting scroll, and a motor and a crankshaft assembly for rotating the orbiting scroll.

The term "scroll device" as used herein may refer to scroll compressors, scroll vacuum pumps, and similar mechanical devices. The term "scroll device" as used herein may also encompasses scroll expanders, with the understanding that scroll expanders absorb heat rather than generating heat, such that the various aspects and elements described herein for cooling scroll devices other than scroll expanders may be used for heating scroll expanders (e.g., using warm liquid).

The preceding is a simplified summary of the disclosure to provide an understanding of some aspects of the disclosure. This summary is neither an extensive nor exhaustive overview of the disclosure and its various aspects, embodiments, and configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and configurations of the disclosure are possible utilizing, alone or in combination, one or more of the features set forth above or described in detail below.

Numerous additional features and advantages are described herein and will be apparent to those skilled in the art upon consideration of the following Detailed Description and in view of the figures.

BRIEF DESCRIPTION OF THE SEVERAL VIEWS OF THE DRAWINGS

The accompanying drawings are incorporated into and form a part of the specification to illustrate several examples of the present disclosure. These drawings, together with the description, explain the principles of the disclosure. The drawings simply illustrate preferred and alternative examples of how the disclosure can be made and used and are not to be construed as limiting the disclosure to only the illustrated and described examples. Further features and advantages will become apparent from the following, more detailed, description of the various aspects, embodiments, and configurations of the disclosure, as illustrated by the drawings referenced below.

DETAILED DESCRIPTION

Figure 1A:
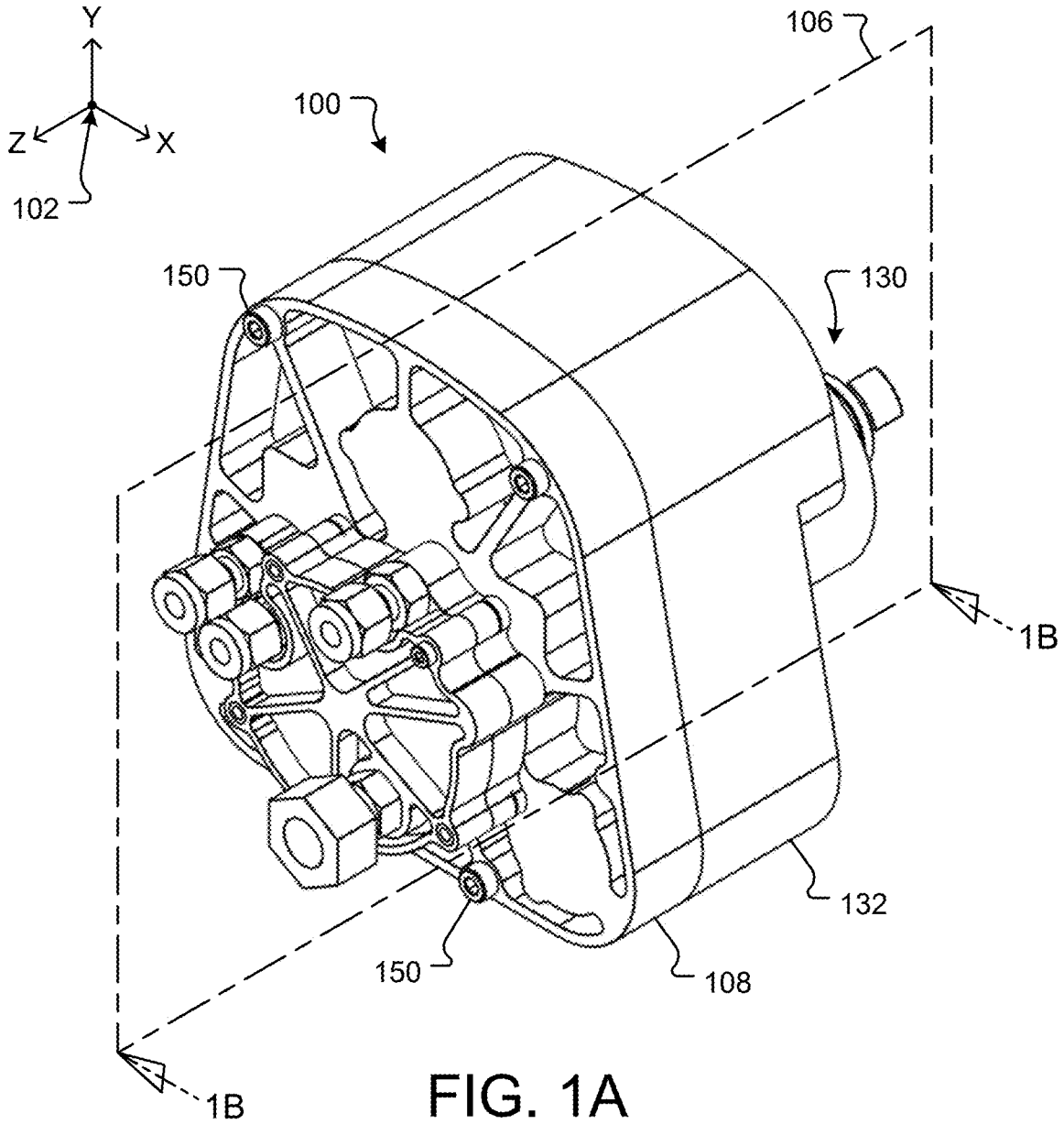
FIG. 1A is an isometric view of a scroll device according to embodiments of the present disclosure.

Before any embodiments of the disclosure are explained in detail, it is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the present disclosure may use examples to illustrate one or more aspects thereof. Unless explicitly stated otherwise, the use or listing of one or more examples (which may be denoted by "for example," "by way of example," "e.g.," "such as," or similar language) is not intended to and does not limit the scope of the present disclosure.

The ensuing description provides embodiments only, and is not intended to limit the scope, applicability, or configuration of the claims. Rather, the ensuing description will provide those skilled in the art with an enabling description for implementing the described embodiments. It being understood that various changes may be made in the function and arrangement of elements without departing from the spirit and scope of the appended claims.

Various aspects of the present disclosure will be described herein with reference to drawings that may be schematic illustrations of idealized configurations.

Scroll devices may include one or more tip seals that are arranged between opposing scrolls. The tip seals generally ensure a seal is created between the scrolls during operation of the scroll device. When assembled, a first scroll of a scroll device is enmeshed, or mated, with a second (opposing) scroll of the scroll device. The first scroll is slightly offset (e.g., by an offset distance) from second scroll along an axial direction. This offset distance may be designed to provide a gap between the first scroll and the second scroll and prevent direct contact between an end portion of at least one involute and an opposing surface of the mating involute. Without such an offset distance, the material of one scroll would directly contact the material of an opposing scroll causing premature wear, heat, and damage to the scroll device. However, to ensure that the scroll device operates at peak efficiency (e.g., in compressing or expanding gasses, fluids, etc.), a seal must be arranged between the scrolls. The tip seals provide this seal between the scrolls. As the scroll device operates, a first tip seal is compressed between a gland seat of a first involute of a first scroll and an opposing surface of a second scroll. In some embodiments, a second tip seal is compressed between a gland seat of a second involute of the second scroll and an opposing surface of the first scroll.

Existing tip seals may be made from rectangular extruded material that is then placed into a corresponding rectangular cross-sectional cut gland seat that is disposed in, and following, one or more of the involutes of a scroll device. However, this rectangular extruded material can be difficult to align with, and/or assemble into, a rectangular cross-sectional cut gland seat. For instance, as the rectangular extruded material is curved to follow the spiral shape of the rectangular cross-sectional cut gland seat, the sharp edges of the rectangular extruded material may hang, or catch, on the sharp edges at the opening of the rectangular cross-sectional cut gland seat. Among other things, this rectangular arrangement can increase the time and effort required to assemble a scroll device. Moreover, the rectangular cross-sectional cut gland seat of an involute may provide sharp internal corners at the depth of the gland seat cut. These sharp corners may contribute to increased stress concentration where the walls of the gland seat meet the base of the gland seat. During operation of the scroll device, the tip seal having a rectangular extruded material may continually shift inside the gland seat (e.g., in a direction perpendicular to the axial direction of the scroll), which may apply forces against the walls of the gland seat that could potentially fracture a portion of the involute. Such a fracture would cause the scroll device to prematurely fail.

It is with respect to the above issues and other problems that the embodiments presented herein were contemplated.

Figure 1B:
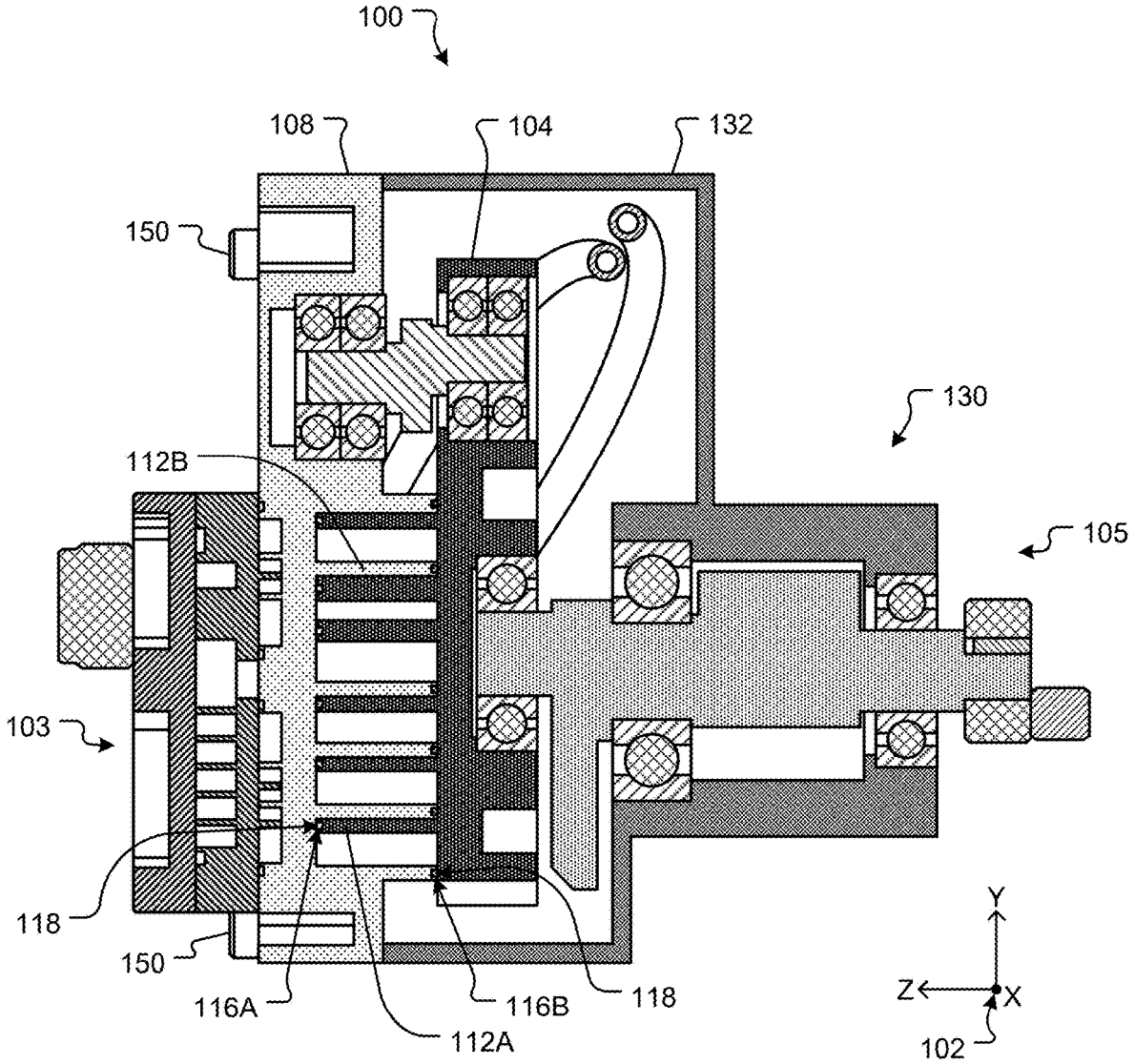
FIG. 1B is a schematic cross-sectional view of the scroll device, taken from arrow "1B" of FIG. 1A, illustrating the arrangement of the gland seats of the scrolls according to embodiments of the present disclosure.
Figure 1C:
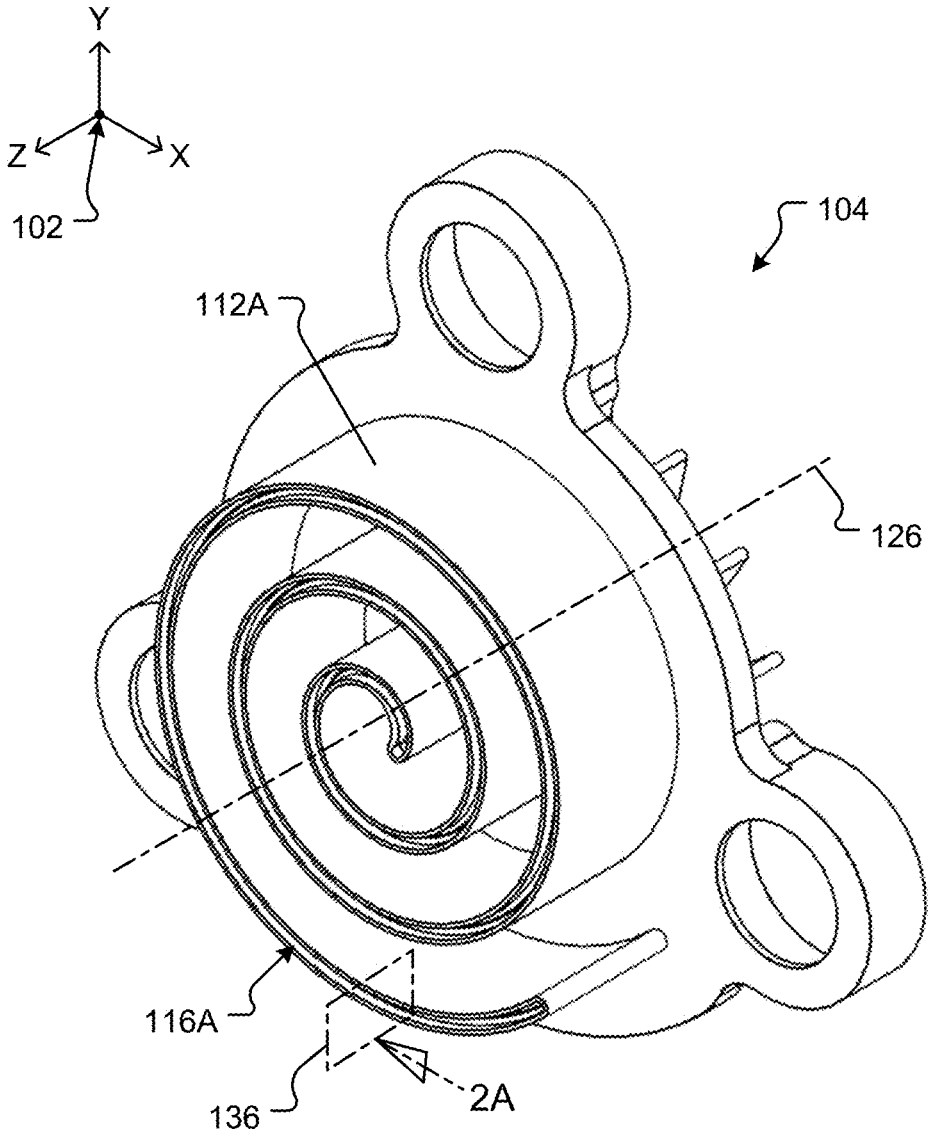
FIG. 1C is an isometric view of the orbiting scroll isolated from the scroll device illustrated in FIGS. 1A and 1B.

Referring now to FIGS. 1A-1C, various views of a scroll device 100 and associated components are shown in accordance with embodiments of the present disclosure. The scroll device 100 is operable to receive a working fluid and either compress the working fluid (e.g., operating as a scroll compressor) or expand the working fluid (e.g., operating as a scroll expander). In the case of a scroll compressor, the working fluid moves from a periphery (e.g., an inlet) of the first involute 112A and the second involute 112B towards the center (e.g., a discharge port, or outlet, etc.) of the first involute 112A and the second involute 112B through increasingly smaller pockets, generating compression of the working fluid. Similar principles apply for a scroll vacuum pump and/or a scroll expander configuration.

Features of the scroll device 100 may be described in conjunction with a coordinate system 102. The coordinate system 102, as shown in the figures, includes three-dimensions comprising an X-axis, a Y-axis, and a Z-axis. Additionally or alternatively, the coordinate system 102 may be used to define planes (e.g., the XY-plane, the XZ-plane, and the YZ-plane) of the scroll device 100. These planes may be disposed orthogonal, or at 90 degrees, to one another. While the origin of the coordinate system 102 may be placed at any point on or near the components of the scroll device 100, for the purposes of description, the axes of the coordinate system 102 are always disposed along the same directions from figure to figure. In some examples, reference may be made to dimensions, angles, directions, relative positions, and/or movements associated with one or more components of the scroll device 100 with respect to the coordinate system 102. For example, the width of the scroll device 100 may be defined as a dimension along the X-axis of the coordinate system 102, the height of the scroll device 100 may be defined as dimension along the Y-axis of the coordinate system 102, and the depth of the scroll device 100 may be defined as a dimension along the Z-axis of the coordinate system 102. In some embodiments, the coordinate system 102 may be used to identify dimensions, angles, or relative positions of portions of subcomponents of the scroll device 100.

In some embodiments, the scroll device 100 may be a part of a larger scroll device assembly including one or more housings, fans, connections, mount surfaces, etc. The scroll device 100 includes an orbiting scroll 104, a fixed scroll 108, a motor 130, a housing 132, one or more fasteners 150, and a plurality of bearings, etc. The plurality of bearings may each include an inner diameter portion, or inner race, and an outer diameter portion, or outer race. The inner race may rotate relative to the outer race, or vice versa. As illustrated in FIG. 1B, the orbiting scroll 104 is arranged relative to the fixed scroll 108 such that a first involute 112A of the orbiting scroll 104 is nested in, or engaged with, a second involute 112B of the fixed scroll 108. Together, the orbiting scroll 104 and fixed scroll 108 form the scroll assembly of the scroll device 100.

The scroll device 100 extends a length from a first end 103 of the scroll device 100 to a second end 105 of the scroll device 100. The scroll assembly is arranged closer to the first end 103 of the scroll device 100 than the second end 105 of the scroll device. The motor 130 is arranged at the second end 105 of the scroll device 100. The motor 130, when actuated, causes the orbiting scroll 104 to rotate relative to the fixed scroll 108 from torque that is transmitted via a crankshaft assembly.

Although described herein with respect to a scroll device 100 including an orbiting scroll 104 and a fixed scroll 108, it should be appreciated that the rounded gland seat arrangement and associated seals may be disposed in any involute of a scroll device 100, including one or more scrolls of orbiting scroll devices, co-rotating scroll devices, and/or other spinning scroll devices.

FIG. 1B shows a schematic cross-sectional view of the scroll device 100 taken through the section plane 106 that passes through a center of the scroll device 100 in the YZ-plane. The scroll device 100 shown in FIG. 1B includes an orbiting scroll 104 enmeshed with a fixed scroll 108. The orbiting scroll 104 includes a first involute 112A and the fixed scroll 108 includes a second involute 112B. The first involute 112A extends in a direction along the Z-axis toward the fixed scroll 108 and the second involute 112B extends in a direction along the Z-axis toward the orbiting scroll 104. Each of the involutes 112A, 112B may include a protrusion that follows a spiral path around a spiral axis 126 (e.g., as shown in FIG. 1C). One or more of the involutes 112A, 112B include gland seats 116A, 116B configured as a recess having internal rounded corners.

FIG. 1C shows an isometric view of the orbiting scroll 104 isolated from the scroll device 100 illustrated in FIGS. 1A and 1B. As provided herein, the gland seats 116A, 116B disposed in the orbiting scroll 104 and the fixed scroll 108 may have the same, or identical, shape. Accordingly, the description of the first gland seat 116A of the orbiting scroll 104 corresponds to the description of second gland seat 116B of the fixed scroll 108, or vice versa, and separate description may be omitted for brevity in disclosure.

Figure 2A:
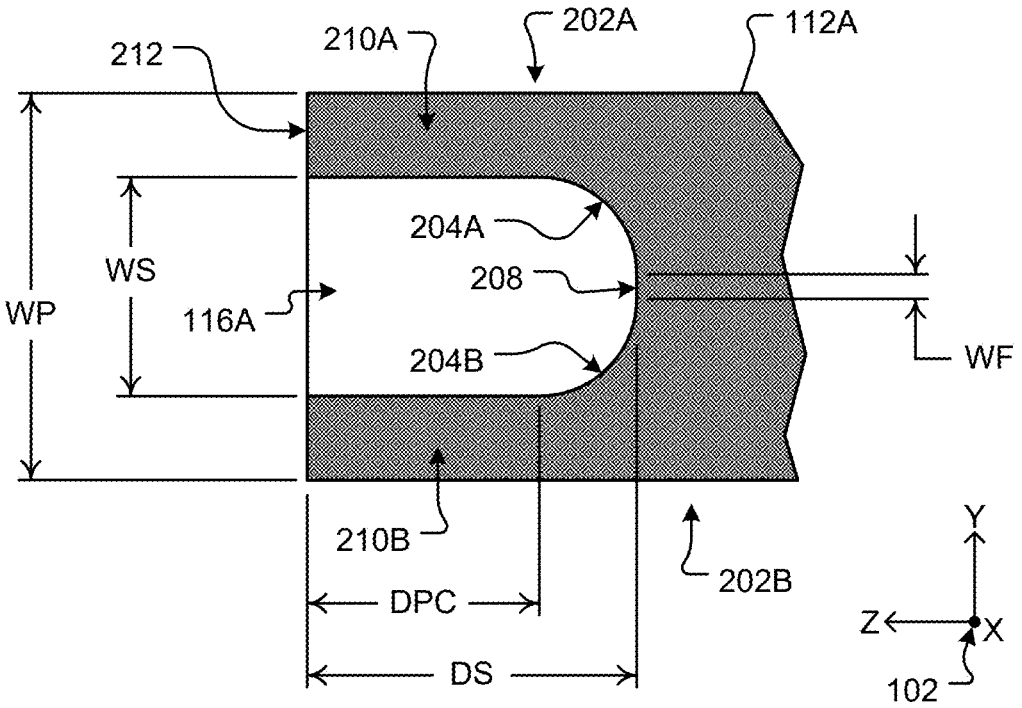
FIG. 2A is a cross-sectional detail view, taken from arrow "2A" of FIG. 1C, illustrating a portion of an involute of a scroll including a gland seat according to embodiments of the present disclosure.

Referring now to FIG. 2A, a cross-sectional detail view taken through the section plane 136 that passes through a center of the orbiting scroll 104 shows a portion of the first involute 112A and first gland seat 116A according to embodiments of the present disclosure. The view shown in FIG. 2A illustrates an end portion of the first involute 112A of the orbiting scroll 104 that is arranged adjacent the fixed scroll 108 when the scroll device 100 is assembled. The first involute 112A includes a first gland seat 116A that is formed extending from the protrusion end 212 into the first involute 112A in the Z-axis direction. The first gland seat 116A may correspond to a recess that follows a majority of the spiral shape of the first involute 112A (e.g., as shown in FIG. 1C). The first gland seat 116A may be closed on the ends of the spiral shape such that the recess is surrounded by a portion of the material of the first involute 112A on all sides. Among other things, this shape of the recess ensures that any compliant member (e.g., gland seat seal 118) inserted in the first gland seat 116A does not move in a direction along the spiral shape and out of the recess and out of the first involute 112A. Stated another way, the first gland seat 116A may constrain, or fix, the gland seat seal 118 disposed therein along the spiral path. The first involute 112A includes a protrusion width, WP, that follows a majority of the spiral shape of the first involute 112A (e.g., as shown in FIG. 1C).

The first gland seat 116A extends into the first involute 112A a seat depth, DS, from the protrusion end 212 to the flat section surface 208. The first gland seat 116A has a seat width, WS, that extends from the protrusion end 212 by a protrusion cut depth, DPC, to a first and second internal radius 204A, 204B. The internal radii 204A, 204B are arranged in the corners of the first gland seat 116A between the recess walls 210A, 210B and the flat section surface 208. Stated another way, the internal radii 204A, 204B join the recess walls 210A, 210B to the flat section surface 208. The first internal radius 204A is separated from the second internal radius 204B by the flat section surface 208 by a flat width, WF. As described above, the flat section surface 208 provides a surface that can be accurately formed in the first involute 112A ensuring a consistent and accurate seat depth, DS. The internal radii 204A, 204B may provide additional material in the corners of the first gland seat 116A that would otherwise be absent in a rectangular-shaped gland seat. In comparison to a rectangular-shaped gland seat that includes no internal radii, the additional material, and arcuate surfaces (e.g., with no sharp corners), provided by the internal radii 204A, 204B may reduce, mitigate, or eliminate stress concentration when the recess walls 210A, 210B are subjected to forces, for example, in the Y-axis direction of FIG. 2A (e.g., during operation of the scroll device 100).

In some embodiments, the first gland seat 116A may be centered along the protrusion width, WP, of the first involute 112A (e.g., shown in FIG. 2A as the Y-axis direction). When the first gland seat 116A is centered along the protrusion width, WP, the width dimension of the first wall 210A is the same as the width dimension of the second wall 210B (e.g., measured along the Y-axis in FIG. 2A). The first gland seat 116A provides a recess in the first involute 112A to receive and at least partially contain a gland seat seal 118. One embodiment of the gland seat seal 118 is shown disposed in the first gland seat 116A of the first involute 112A in FIG. 2B. When disposed at least partially in the first gland seat 116A, the gland seat seal 118 provides a seal between the orbiting scroll 104 and the fixed scroll 108 of the scroll device 100 and prevents the passage of a working fluid from the first side 202A to the second side 202B of the first involute 112A across the first gland seat 116A, or vice versa. Examples, of the material gland seat seal 118 may include, but are in no way limited to, an ethylene propylene, fluoroelastomer, fluorosilicone, neoprene, nitrile, perfluoroelastomer, polymer, polysiloxane, polyurethane, propylene, rubber, silicone, tetrafluoroethylene, trafluoroethylene/propylene, etc., and/or combinations thereof.

Figure 2B:
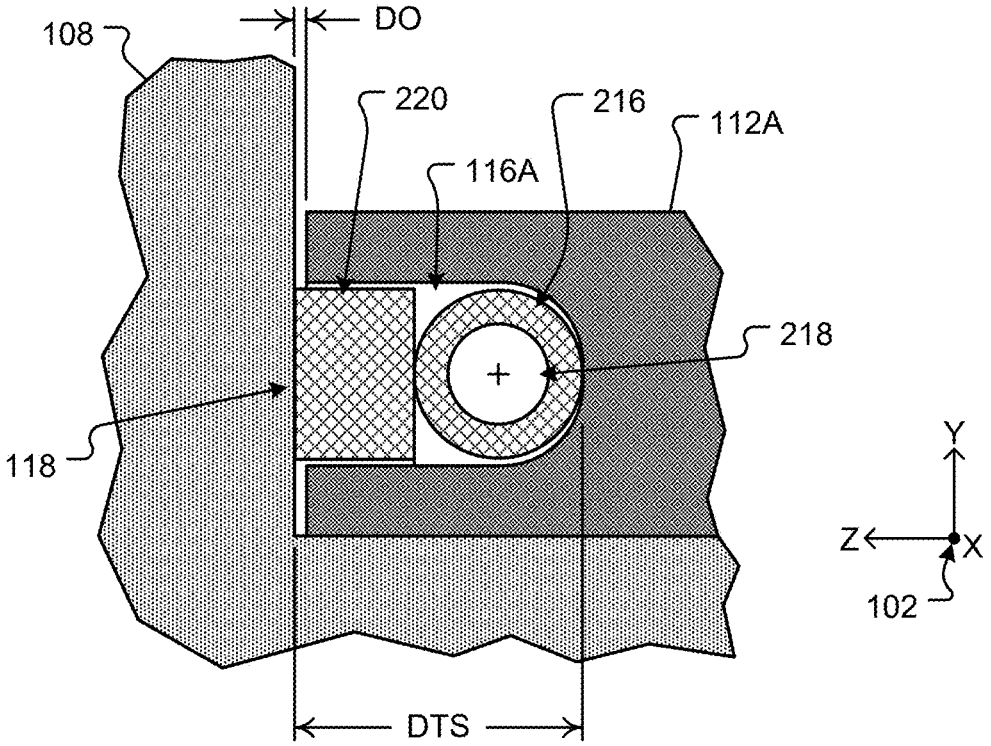
FIG. 2B is a cross-sectional detail view, in a same viewing orientation as FIG. 2A, of a gland seat seal including a backup seal and a tip seal disposed in the gland seat of a first scroll and contacting an opposing surface of a second scroll according to embodiments of the present disclosure.

FIG. 2B shows a cross-sectional detail view of a gland seat seal 118 including a backup seal 216 and a tip seal 220 disposed in the first gland seat 116A in accordance with embodiments of the present disclosure. The gland seat seal 118 is shown including the backup seal 216 in contact with the flat section surface 208 of the first gland seat 116A and the tip seal 220 extending from the first gland seat 116A in contact with an opposing surface of the second scroll 108. As described above, the orbiting scroll 104 is offset from fixed scroll 108 along an axial direction by an offset distance, DO. This offset distance, DO, is shown as extending between the protrusion end 212 of the first involute 112A and the fixed scroll 108 in the Z-axis in FIG. 2B. The backup seal 216 is configured to apply a force against the tip seal 220, pushing the tip seal 220 against the fixed scroll 108. For example, the gland seat seal 118 may be operatively coupled with the first gland seat 116A such that the backup seal 216 and/or the tip seal 220 are compressed to the total seal depth, DTS, dimension. In some embodiments, the gland seat seal 118 may be "preloaded" by compressing the backup seal 216 and/or the tip seal 220 (e.g., between the flat section surface 208 and the fixed scroll 108) by 10%, 20%, 30%, 40%, 50%, 60%, 70%, 80%, or more of the total uncompressed depth of the gland seat seal 118. In any event, the tip seal 220 extends into the gap between the first involute 112A and the fixed scroll 108 defined by the offset distance, DO, and creates a seal between the first side 202A and the second side 202B of the first involute 112A across the first gland seat 116A.

As illustrated in FIG. 2B, the gland seat seal 118 includes a backup seal 216 and a tip seal 220. The backup seal 216 may be configured as an extruded compliant material including a circular cross-sectional shape and a hollow portion 218 arranged in the center thereof. However, the geometry and/or cross-sectional shape of the backup seal 216 is not so limited and may include any shape having an arcuate portion that is arranged adjacent to the flat section surface 208 and the internal radii 204A, 204B. The tip seal 220 may be configured as an extruded compliant material including a rectangular cross-sectional shape. The cross-sectional shape of the tip seal 220 is not limited to the rectangular shape shown in FIG. 2B and may include any shape having a flat surface portion that extends out of the first gland seat 116A and is arranged adjacent to the fixed scroll 108. In some embodiments, the backup seal 216 and the tip seal 220 may be made from different materials including different properties (e.g., mechanical properties, hardness, elasticity, tensile strength, etc.). For instance, the backup seal 216 of the gland seat seal 118 may be made from a compliant material that provides the compressive force for the gland seat seal 118 and the tip seal 220 may be made from a material that offers better wear resistance, lower friction, and/or enhanced rigidity when compared to the compliant material of the backup seal 216. As can be appreciated, the gland seat seal 118 may be tuned to suit a particular application, and allow for greater material selections that would otherwise be unavailable if the gland seat seal 118 were made from a single material.

Figure 3A:
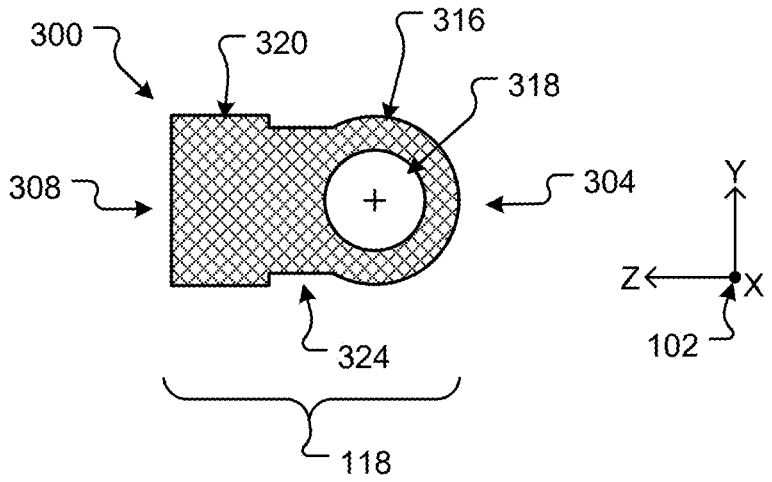
FIG. 3A is a schematic cross-sectional view of a gland seat seal including a unified tip and backup seal according to embodiments of the present disclosure.

FIG. 3A shows a schematic cross-sectional view of a gland seat seal 118 including a unified tip and backup seal 300 according to embodiments of the present disclosure. The unified tip and backup seal 300 includes a backup portion 316, a tip portion 320, and a transition region 324 arranged between the backup portion 316 and the tip portion 320. The unified tip and backup seal 300 extends an overall depth dimension, measured along the Z-axis, from a seat side 304 of the gland seat seal 118 to a tip side 308 of the gland seat seal 118. The unified tip and backup seal 300 may include one or more hollow portions 318. These one or more hollow portions 318 may be arranged to allow for a portion of the unified tip and backup seal 300 to compress greater than other areas or portions of the unified tip and backup seal 300 without the hollow portions 318. The unified tip and backup seal 300 may be made from an extruded material (e.g., in a continuous length that is cut to fit the overall spiral length of the first gland seat 116A).

Figure 3B:
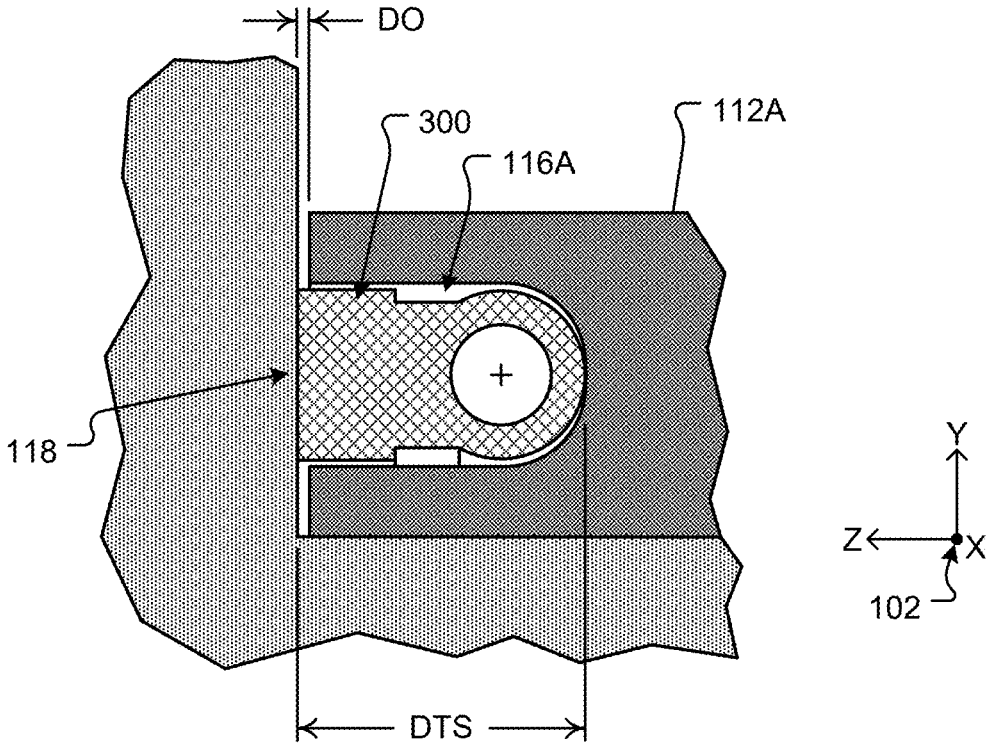
FIG. 3B is a cross-sectional detail view, in a same viewing orientation as FIG. 2A, of a gland seat seal including the unified tip and backup seal of FIG. 3A disposed in the gland seat of a first scroll and contacting an opposing surface of a second scroll according to embodiments of the present disclosure.

FIG. 3B is a cross-sectional detail view of the gland seat seal 118 of FIG. 3A, including the unified tip and backup seal 300, disposed in the first gland seat 116A in accordance with embodiments of the present disclosure. The gland seat seal 118 of FIG. 3B is shown including the backup portion 316 in contact with the flat section surface 208 of the first gland seat 116A and the tip portion 320 extending from the first gland seat 116A in contact with an opposing surface of the second scroll 108. As provided above, the orbiting scroll 104 is offset from fixed scroll 108 along an axial direction by an offset distance, DO. This offset distance, DO, is shown as extending between the protrusion end 212 of the first involute 112A and the fixed scroll 108 in the Z-axis in FIG. 3B. The unified tip and backup seal 300 is configured to push the tip portion 320 of the unified tip and backup seal 300 against the fixed scroll 108. For instance, the unified tip and backup seal 300 may be operatively coupled with the first gland seat 116A such that the gland seat seal 118 is compressed to the total seal depth, DTS, dimension. In some embodiments, the gland seat seal 118 may be "preloaded" by compressing unified tip and backup seal 300 (e.g., between the flat section surface 208 and the fixed scroll 108) by 10%, 20%, 30%, 40%, 50%, 60%, 70%, 80%, or more of the total uncompressed depth of the gland seat seal 118. In any event, the tip portion 320 extends into the gap between the first involute 112A and the fixed scroll 108 defined by the offset distance, DO, and creates a seal between the first side 202A and the second side 202B of the first involute 112A across the first gland seat 116A.

As illustrated in FIGS. 3A and 3B, the gland seat seal 118 includes a transition region 324 disposed between the backup portion 316 and the tip portion 320. This transition region 324 may comprise a region of the unified tip and backup seal 300 that allows the gland seat seal 118 to compress along the Z-axis direction and provide an area for the material of the gland seat seal 118 to expand into the space of the first gland seat 116A shown between the recess walls 210A, 210B (e.g., expanding the transition region 324 in the Y-axis direction shown in FIG. 3B). The unified tip and backup seal 300 may be configured as an extruded compliant material. However, the geometry and/or cross-sectional shape of the unified tip and backup seal 300 is not limited to the arrangement shown in FIGS. 3A and 3B, and may include any shape having an arcuate portion that is arranged adjacent to the flat section surface 208 and the internal radii 204A, 204B and a flat surface portion that extends out of the first gland seat 116A and is arranged adjacent to the fixed scroll 108.

The gland seat seal 118 and the gland seats 116A, 116B described herein may be arranged to prevent leakage of a working fluid from inside the pockets between two enmeshed scrolls of a scroll device 100. In some embodiments, tip seals 220 or tip portions 320 may be provided along the distal edge of each involute. In particular, a tip seal 220 or tip portion 320 of a gland seat seal 118 may be provided along the edge of a first involute that is proximate a second scroll (such that the a tip seal 220 or tip portion 320 contacts the second scroll), and another a tip seal 220 or tip portion 320 of a gland seat seal 118 may be provided along the edge of a second involute that is proximate the first scroll (such that the a tip seal 220 or tip portion 320 contacts the first scroll).

The gland seats 116A, 116B may be formed into the first involute 112A and/or the second involute 112B as shown and described above. The gland seats 116A, 116B may be formed to house the gland seat seal 118. The gland seat seal 118 may actuate, via compression, by exerting a force onto a tip seal 220 or tip portion 320 to push the tip seal 220 or tip portion 320 against a surface of an opposing scroll to form a seal between the tip seal 220 or tip portion 320 and the surface of the scroll. Such a seal may prevent leakage for the working fluid from the pocket formed during compression or expansion (e.g., during operation of the scroll device 100).

The gland seats 116A, 116B may be machined or otherwise formed to be fully rounded or partially rounded. When partially rounded, each wall of the involute 112A, 112B is finished with radiused portions (e.g., internal radii 204A, 204B) and a flat portion (e.g., flat section surface 208). between the radiused portions. In embodiments where the gland seats 116A, 116B is rounded or partially rounded, the portion of the gland seat seal 118 arranged adjacent the flat section surface 208 may be rounded. In other embodiments, portions of the gland seats 116A, 116B may have a rectangular shape to receive a rectangular portion of the gland seat seal 118.

Additionally or alternatively, the gland seat seal 118 may be configured as a unified tip and backup seal 300. In such embodiments, the tip seal 220 and the backup seal 216 of the gland seat seal 118 may be integrated into one piece and/or formed from a single piece. It will be appreciated that in other embodiments (as described above), the tip seal 220 and the backup seal 216 may be two separate components.

Throughout the present disclosure, various embodiments have been disclosed. Components described in connection with one embodiment are the same as or similar to like-numbered components described in connection with another embodiment.

Any of the steps, functions, and operations discussed herein can be performed continuously and automatically.

While the flowcharts have been discussed and illustrated in relation to a particular sequence of events, it should be appreciated that changes, additions, and omissions to this sequence can occur without materially affecting the operation of the disclosed embodiments, configuration, and aspects.

The exemplary systems and methods of this disclosure have been described in relation to scroll devices and gland seat assemblies. However, to avoid unnecessarily obscuring the present disclosure, the preceding description omits a number of known structures and devices. This omission is not to be construed as a limitation of the scope of the claimed disclosure. Specific details are set forth to provide an understanding of the present disclosure. It should, however, be appreciated that the present disclosure may be practiced in a variety of ways beyond the specific detail set forth herein.

A number of variations and modifications of the disclosure can be used. It would be possible to provide for some features of the disclosure without providing others.

References in the specification to "one embodiment," "an embodiment," "an example embodiment," "some embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in conjunction with one embodiment, it is submitted that the description of such feature, structure, or characteristic may apply to any other embodiment unless so stated and/or except as will be readily apparent to one skilled in the art from the description. The present disclosure, in various embodiments, configurations, and aspects, includes components, methods, processes, systems and/or apparatus substantially as depicted and described herein, including various embodiments, subcombinations, and subsets thereof. Those of skill in the art will understand how to make and use the systems and methods disclosed herein after understanding the present disclosure. The present disclosure, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and/or reducing cost of implementation.

The foregoing discussion of the disclosure has been presented for purposes of illustration and description. The foregoing is not intended to limit the disclosure to the form or forms disclosed herein. In the foregoing Detailed Description for example, various features of the disclosure are grouped together in one or more embodiments, configurations, or aspects for the purpose of streamlining the disclosure. The features of the embodiments, configurations, or aspects of the disclosure may be combined in alternate embodiments, configurations, or aspects other than those discussed above. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the disclosure.

Moreover, though the description of the disclosure has included description of one or more embodiments, configurations, or aspects and certain variations and modifications, other variations, combinations, and modifications are within the scope of the disclosure, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

Exemplary aspects are directed to a scroll device, comprising: a first scroll comprising a first involute comprising a first gland seat extending a first depth into the first involute and following a spiral path defined by the first involute, the first gland seat comprising a first recess defined by a recess arrangement including a first wall, a second wall offset a first width from the first wall, a flat section surface arranged between the first wall and the second wall, a first radiused corner interconnected to the first wall and the flat section surface, and a second radiused corner interconnected to the second wall and the flat section surface, wherein the first radiused corner and the second radiused corner are separated by the flat section surface; a second scroll operatively coupled to the first scroll, the second scroll comprising a second involute; and a first gland seat seal comprising a backup seal portion and a tip seal portion, wherein the backup seal portion is arranged inside the first gland seat in contact with the flat section surface, and wherein the tip seal portion is arranged at least partially in the first gland seat in contact with a surface of the second scroll, and wherein the backup seal portion comprises a rounded shape.

Any one or more of the above aspects include wherein the backup seal portion and the tip seal portion of the first gland seat seal are formed together as a unified tip and backup seal. Any one or more of the above aspects include wherein the first gland seat seal comprises a transition region arranged between the backup seal portion and the tip seal portion, and wherein the transition region comprises a cross-sectional transition width that is less than a cross-sectional width of the tip seal portion. Any one or more of the above aspects include wherein the backup seal portion is made from a first material, wherein the tip seal portion is made from a second material, and wherein the first material is different from the second material. Any one or more of the above aspects include wherein the backup seal portion and the tip seal portion are made from a common material. Any one or more of the above aspects include wherein the backup seal portion comprises a hollow portion, and wherein the backup seal portion is made from a compliant material. Any one or more of the above aspects include wherein the backup seal portion comprises a hollow circular cross-sectional shape, and wherein the tip seal portion comprises a solid rectangular cross-sectional shape. Any one or more of the above aspects further comprising: a second gland seat extending a second depth into the second involute and following a spiral path defined by the second involute, wherein the second gland seat comprises a second recess defined by the recess arrangement; and a second gland seat seal comprising a backup seal portion and a tip seal portion, wherein the backup seal portion of the second gland seat seal is arranged inside the second gland seat in contact with the flat section surface of the second recess, and wherein the tip seal portion of the second gland seat is arranged at least partially in the second gland seat in contact with a surface of the first scroll, and wherein the backup seal portion of the second gland seat seal comprises a rounded shape. Any one or more of the above aspects include wherein the surface of the second scroll is offset a distance from an end surface of the first involute, and wherein the surface of the first scroll is offset the distance from an end surface of the second involute. Any one or more of the above aspects include wherein the scroll device comprises a co-rotating scroll device or an orbiting scroll device.

Exemplary aspects are directed to a scroll device, comprising: a first scroll comprising a first involute; a second scroll comprising a second involute, the second scroll operatively coupled to the first scroll, wherein the first scroll and the second scroll each comprise a gland seat extending into the first involute and the second involute, the gland seat comprising: a recess including a first wall, a second wall offset a first width from the first wall, a flat section surface arranged between the first wall and the second wall, a first radiused corner interconnected to the first wall and the flat section surface, and a second radiused corner interconnected to the second wall and the flat section surface, wherein the first radiused corner and the second radiused corner are separated by the flat section surface; a first gland seat seal arranged in the gland seat of the first scroll; and a second gland seat seal arranged in the gland seat of the second scroll, wherein the first gland seat seal and the second gland seat seal each comprise: a backup seal portion; and a tip seal portion; wherein the tip seal portion of the first gland seat seal is arranged in contact with a surface of the second scroll, and wherein the tip seal portion of the second gland seat seal is arranged in contact with a surface of the first scroll.

Any one or more of the above aspects include wherein the backup seal portion is fully rounded at a point adjacent the flat section surface. Any one or more of the above aspects include wherein the backup seal portion and the tip seal portion are formed together as a unified tip and backup seal. Any one or more of the above further comprising: a transition region arranged between the backup seal portion and the tip seal portion, and wherein the transition region comprises a cross-sectional transition width that is less than a cross-sectional width of the tip seal portion. Any one or more of the above aspects include wherein the backup seal portion is made from a first material, wherein the tip seal portion is made from a second material, and wherein the first material is different from the second material. Any one or more of the above aspects include wherein the backup seal portion and the tip seal portion are made from a common material. Any one or more of the above aspects include wherein the backup seal portion comprises a hollow circular cross-sectional shape, and wherein the tip seal portion comprises a solid rectangular cross-sectional shape.

Exemplary aspects are directed to a scroll device, comprising: a first scroll having a first plate, a first involute extending from the first plate, the first involute having a first seat gland; a second scroll having a second plate, a second involute extending from the second plate, the second involute having a second seat gland, wherein the first involute and the second involute are nested; a first tip seal disposed on an edge of the first involute and a second tip seal disposed on an edge of the second involute; and a first backup seal disposed in the first seat gland and a second backup seal disposed in the second seat gland, wherein the first backup seal and the second backup seal actuate the first tip seal and the second tip seal, respectively.

Any one or more of the above aspects include wherein the first seat gland and the second seat gland are each partially rounded. Any one or more of the above aspects include wherein the first seat gland and the second seat gland are each fully rounded.

Any one or more of the above aspects/embodiments as substantially disclosed herein.

Any one or more of the aspects/embodiments as substantially disclosed herein optionally in combination with any one or more other aspects/embodiments as substantially disclosed herein.

One or means adapted to perform any one or more of the above aspects/embodiments as substantially disclosed herein.

Any one or more of the features disclosed herein.

Any one or more of the features as substantially disclosed herein.

Any one or more of the features as substantially disclosed herein in combination with any one or more other features as substantially disclosed herein.

Any one of the aspects/features/embodiments in combination with any one or more other aspects/features/embodiments.

Use of any one or more of the aspects or features as disclosed herein.

It is to be appreciated that any feature described herein can be claimed in combination with any other feature(s) as described herein, regardless of whether the features come from the same described embodiment.

As used herein, the singular forms "a," "an," and "the" are intended to include the plural forms as well, unless the context clearly indicates otherwise. It will be further understood that the terms "include," "including," "includes," "comprise," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The phrases "at least one," "one or more," "or," and "and/or" are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B, and C together. When each one of A, B, and C in the above expressions refers to an element, such as X, Y, and Z, or a class of elements, such as X1-Xn, Y1-Ym, and Z1-Zo, the phrase is intended to refer to a single element selected from X, Y, and Z, a combination of elements selected from the same class (e.g., X1 and X2) as well as a combination of elements selected from two or more classes (e.g., Y1 and Zo).

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

The terms "determine," "calculate," "compute," and variations thereof, as used herein, are used interchangeably and include any type of methodology, process, mathematical operation, or technique.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and this disclosure.

It should be understood that every maximum numerical limitation given throughout this disclosure is deemed to include each and every lower numerical limitation as an alternative, as if such lower numerical limitations were expressly written herein. Every minimum numerical limitation given throughout this disclosure is deemed to include each and every higher numerical limitation as an alternative, as if such higher numerical limitations were expressly written herein. Every numerical range given throughout this disclosure is deemed to include each and every narrower numerical range that falls within such broader numerical range, as if such narrower numerical ranges were all expressly written herein.

What is claimed is:

1. A scroll device, comprising:

a first scroll comprising a first involute comprising a first gland seat extending a first depth into the first involute and following a spiral path defined by the first involute, the first gland seat comprising a first recess defined by a recess arrangement including a first wall, a second wall offset a first width from the first wall, a flat section surface arranged between the first wall and the second wall at a center of the first width, a first radiused corner interconnected to the first wall and interconnected to the flat section surface adjacent the center of the first width, and a second radiused corner interconnected to the second wall and interconnected to the flat section surface adjacent the center of the first width, wherein the first radiused corner and the second radiused corner are separated by the flat section surface;

a second scroll operatively coupled to the first scroll, the second scroll comprising a second involute; and a first gland seat seal comprising a backup seal portion and a tip seal portion, wherein the backup seal portion is arranged inside the first gland seat in contact with the flat section surface, and wherein the tip seal portion is arranged at least partially in the first gland seat in contact with a surface of the second scroll, and wherein the backup seal portion comprises a rounded shape.

2. The scroll device of claim 1, wherein the backup seal portion and the tip seal portion of the first gland seat seal are formed together as a unified tip and backup seal.

3. The scroll device of claim 2, wherein the first gland seat seal comprises a transition region arranged between the backup seal portion and the tip seal portion, and wherein the transition region comprises a cross-sectional transition width that is less than a cross-sectional width of the tip seal portion.

4. The scroll device of claim 1, wherein the backup seal portion is made from a first material, wherein the tip seal portion is made from a second material, and wherein the first material is different from the second material.

5. The scroll device of claim 1, wherein the backup seal portion and the tip seal portion are made from a common material.

6. The scroll device of claim 1, wherein the backup seal portion comprises a hollow portion, and wherein the backup seal portion is made from a compliant material.

7. The scroll device of claim 1, wherein the backup seal portion comprises a hollow circular cross-sectional shape, and wherein the tip seal portion comprises a solid rectangular cross-sectional shape.

8. The scroll device of claim 1, further comprising:

a second gland seat extending a second depth into the second involute and following a spiral path defined by the second involute, wherein the second gland seat comprises a second recess defined by the recess arrangement; and a second gland seat seal comprising a backup seal portion and a tip seal portion, wherein the backup seal portion of the second gland seat seal is arranged inside the second gland seat in contact with the flat section surface of the second recess, and wherein the tip seal portion of the second gland seat is arranged at least partially in the second gland seat in contact with a surface of the first scroll, and wherein the backup seal portion of the second gland seat seal comprises a rounded shape.

9. The scroll device of claim 1, wherein the surface of the second scroll is offset a distance from an end surface of the first involute, and wherein the surface of the first scroll is offset the distance from an end surface of the second involute.

10. The scroll device of claim 1, wherein the scroll device comprises a co-rotating scroll device or an orbiting scroll device.

11. A scroll device, comprising:

a first scroll comprising a first involute; and a second scroll comprising a second involute, the second scroll operatively coupled to the first scroll, wherein the first scroll and the second scroll each comprise a gland seat extending into the first involute and the second involute, the gland seat comprising:

a recess including a first wall, a second wall offset a first width from the first wall, a flat section surface arranged between the first wall and the second wall at a center of the first width, a first radiused corner interconnected to the first wall and interconnected to the flat section surface adjacent the center of the first width, and a second radiused corner interconnected to the second wall and interconnected to the flat section surface adjacent the center of the first width, wherein the first radiused corner and the second radiused corner are separated by the flat section surface;

a first gland seat seal arranged in the gland seat of the first scroll; and a second gland seat seal arranged in the gland seat of the second scroll, wherein the first gland seat seal and the second gland seat seal each comprise:

a backup seal portion; and a tip seal portion;

wherein the tip seal portion of the first gland seat seal is arranged in contact with a surface of the second scroll, and wherein the tip seal portion of the second gland seat seal is arranged in contact with a surface of the first scroll.

12. The scroll device of claim 11, wherein the backup seal portion is fully rounded at a point adjacent the flat section surface.

13. The scroll device of claim 11, wherein the backup seal portion and the tip seal portion are formed together as a unified tip and backup seal.

14. The scroll device of claim 13, further comprising:

a transition region arranged between the backup seal portion and the tip seal portion, and wherein the transition region comprises a cross-sectional transition width that is less than a cross-sectional width of the tip seal portion.

15. The scroll device of claim 11, wherein the backup seal portion is made from a first material, wherein the tip seal portion is made from a second material, and wherein the first material is different from the second material.

16. The scroll device of claim 11, wherein the backup seal portion and the tip seal portion are made from a common material.

17. The scroll device of claim 11, wherein the backup seal portion comprises a hollow circular cross-sectional shape, and wherein the tip seal portion comprises a solid rectangular cross-sectional shape.

18. A scroll device comprising:

a first scroll having a first plate, a first involute extending from the first plate, the first involute comprising a first gland seat extending a first seat depth into the first involute, wherein the first gland seat comprises a first wall extending into the first involute and a second wall extending into the first involute, wherein the first wall is offset from the second wall by a first width, wherein a first radiused corner extends from a first point adjacent a center of the first width at the first seat depth to the first wall, and wherein a second radiused corner extends from a second point adjacent the center of the first width at the first seat depth to the second wall;

a second scroll having a second plate, a second involute extending from the second plate, the second involute having a second gland seat, wherein the first involute and the second involute are nested with one another;

a first tip seal disposed on an edge of the first involute and a second tip seal disposed on an edge of the second involute; and a first backup seal disposed in the first gland seat and a second backup seal disposed in the second gland seat, wherein the first backup seal and the second backup seal actuate the first tip seal and the second tip seal, respectively.

19. The scroll device of claim 18, wherein the first gland seat comprises a flat section surface arranged at the first seat depth, wherein the first point adjacent the center of the first width is arranged in contact with the flat section surface, and wherein the second point adjacent the center of the first width is arranged in contact with the flat section surface.

20. The scroll device of claim 18, wherein the first gland seat and the second gland seat are each fully rounded extending from the first wall to the first seat depth and from the first seat depth to the second wall.

* * * * *